United States Patent [19]

Imaeda

[11] Patent Number: 4,990,112

[45] Date of Patent: Feb. 5, 1991

[54] POWER TRANSMITTING DEVICE FOR MARINE PROPULSION UNIT

[75] Inventor: Hirofumi Imaeda, Hamamatsu, Japan

[73] Assignee: Sanshin Kogyo Kabushiki Kaisha, Hamamatsu, Japan

[21] Appl. No.: 357,475

[22] Filed: May 26, 1989

[30] Foreign Application Priority Data

Jun. 1, 1988 [JP] Japan ..... 63-134825

[51] Int. Cl.[5] ..... B63H 21/28

[52] U.S. Cl. ..... 440/75; 440/900

[58] Field of Search ..... 440/75, 76, 83, 900, 440/111, 78, 113

[56] References Cited

U.S. PATENT DOCUMENTS

| | | | |
|---|---|---|---|
| 3,727,574 | 4/1973 | Bagge | 440/75 X |
| 3,952,687 | 4/1976 | Brownlie et al. | 440/75 |
| 4,302,196 | 11/1981 | Blanchard | 440/75 |
| 4,689,027 | 8/1987 | Harada et al. | 440/83 |

FOREIGN PATENT DOCUMENTS 61-175344 2/1985 Japan .

*Primary Examiner*—Joseph F. Peters, Jr.
*Assistant Examiner*—Edwin L. Swinehart
*Attorney, Agent, or Firm*—Ernest A. Beutler

[57] ABSTRACT

Several embodiments of arrangements for transmitting driving thrusts from the bearing carrier of a lower unit to the lower unit housing at the rear end of the bearing carrier so as to permit a compact and streamlined relationship while affording high thrust transfer areas.

7 Claims, 3 Drawing Sheets

POWER TRANSMITTING DEVICE FOR MARINE PROPULSION UNIT

BACKGROUND OF THE INVENTION

This invention relates to a power transmitting device for a marine propulsion unit and more particularly to an improved construction for transmitting the driving thrust from a propeller shaft to the lower housing of such a unit.

In marine propulsion units, there is normally provided a lower unit that comprises an outer casing which defines a cavity in which a driven shaft is journaled. The driven shaft drives a propulsion unit such as a propeller for propelling the associated watercraft through a body of water. Normally, the driven shaft is supported within a bearing carrier that is inserted into an opening formed in the rear of the lower unit housing and which opens into the cavity. Frequently, the driving thrust as well as the rotational support for the driven shaft are transmitted from this shaft to the watercraft through the bearing carrier and its cooperation with the lower unit housing. Normally, the cavity in which the driven shaft is supported also contains a forward, neutral, reverse transmission for selectively driving the watercraft in forward or reverse directions.

It is the general practice, when the driving thrust is transmitted to the lower unit housing from the bearing carrier to have the bearing carrier formed with a forwardly facing shoulder that engages a shoulder on the lower unit around the cavity. This thrust transferring engagement is normally positioned in close proximity to the forward, neutral, reverse transmission. As a result, if large driving thrusts are to be transmitted, the bearing surfaces must have substantial area and this tends to increase the overall dimension of the forward portion of the lower unit casing. Such increases in size are, however, undesirable because this increases the drag on the lower unit and the power required to move it through the water.

It is, therefore, a principal object of this invention to provide an improved arrangement for transmitting driving thrusts to the lower unit of a marine propulsion device.

It is a further object of this invention to provide a thrust transmitting arrangement for the bearing carrier of a marine propulsion lower unit that permits large bearing areas while, at the same time, permitting a compact and streamlined configuration.

SUMMARY OF THE INVENTION

This invention is adapted to be embodied in a lower unit for a marine propulsion device that is comprised of an outer casing defining a cavity that extends through the rear face of the outer casing. A driven shaft extends at least in part within the cavity and drives a propulsion means for the associated watercraft. A bearing carrier is supported within the cavity and closes at least in part the rear opening thereof. Bearing means are carried by the bearing carrier and journal the driven shaft. The bearing means take thrust from the driven shaft in at least one direction and transfer the thrust forces to the bearing carrier. In accordance with the invention, means are provided for transmitting the thrust from the bearing carrier to the outer housing contiguous to the rear opening.

DETAILED DESCRIPTION OF THE PREFERRED EMBODIMENTS

Figure 1:
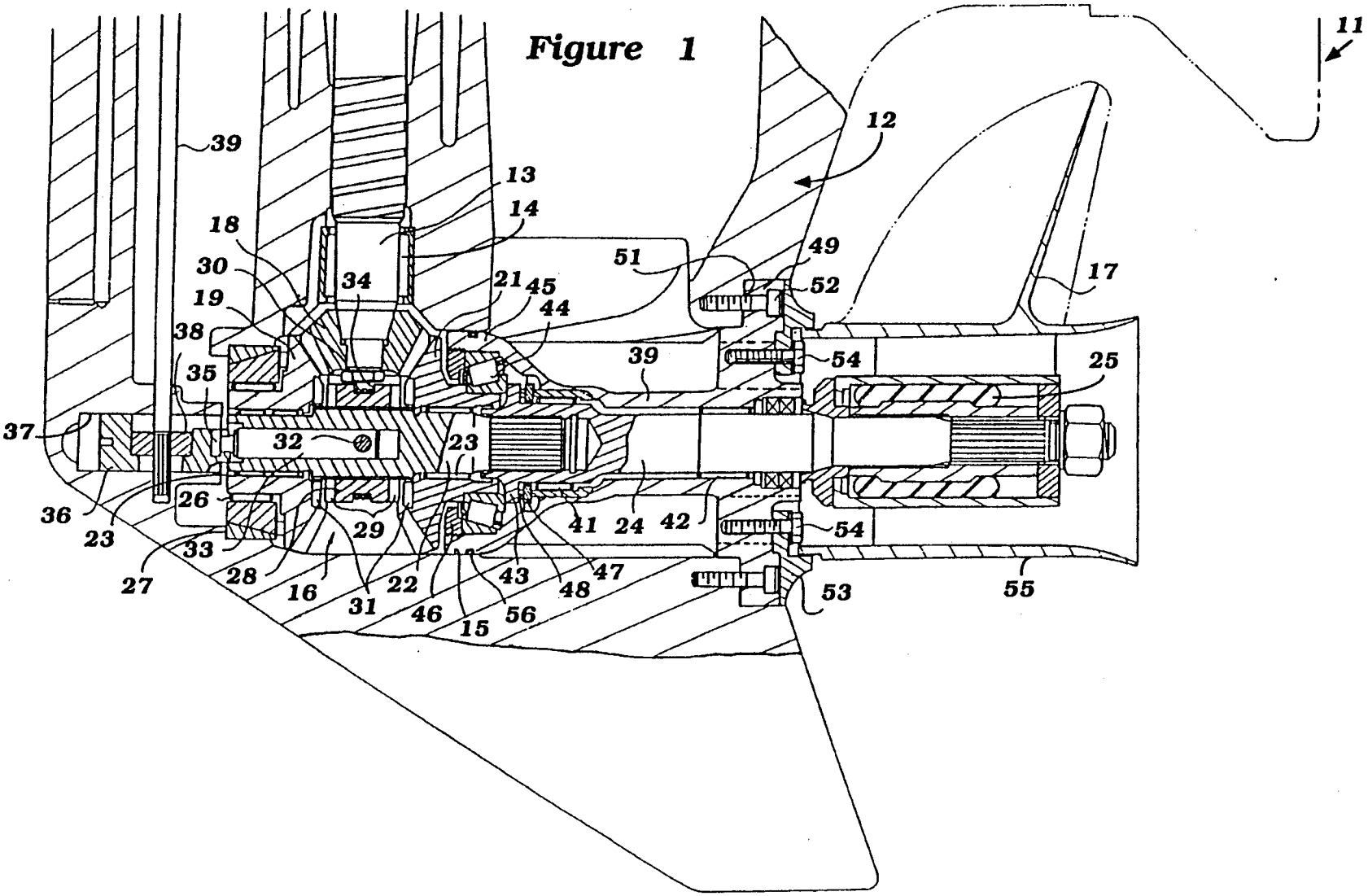
FIG. 1 is a cross-sectional view taken through the lower unit of a marine propulsion unit constructed in accordance with a first embodiment of the invention.

Referring first to the embodiment of FIG. 1, a lower unit for a marine propulsion device is shown partially and is identified generally by the reference numeral 11. The lower unit 11 may comprise the lower unit of an outboard motor or the lower unit of the outboard portion of an inboard/outboard drive. Such units are characterized as marine propulsion devices generally herein in the specification and claims.

The lower unit 11 is comprised of an outer housing, indicated generally by the reference numeral 12 and which is formed from a light weight material such as cast aluminum. A drive shaft 13 is journaled within the lower unit 12 by means of a supporting bearing 14 and is driven at the upper end thereof from a suitable power source. If the outboard drive 11 is an outboard motor, this power source will be an internal combustion engine supported and contained within the power head thereof. If the lower unit 11 is that of an outboard drive of an inboard/outboard arrangement, the powering internal combustion engine will be mounted within the hull of the associated watercraft.

The housing 12 defines a generally longitudinally extending cavity 15 in which a forward, neutral, reverse transmission 16 is positioned for selectively driving a propeller 17 in forward or reverse directions. This forward, neutral, reverse transmission is comprised of a driving bevel gear 18 that is affixed in a suitable manner to the lower end of the drive shaft 13. The driving bevel gear 18 is in mesh with a pair of counter rotating driven bevel gears 19 and 21 which are supported within the cavity 15 in a manner which will be described. Basically, these driven bevel gears 19 and 21 are journaled upon an intermediate shaft 22 by means of spaced anti-friction bearings 23. The intermediate shaft 22 has a splined rear end which is received within a splined female opening of a driven propeller shaft 24. The propeller shaft 24 is affixed to the propeller 17 by means of an elastic coupling 25.

There is provided an anti-friction bearing 26 that engages the outer end of a hub of the driven bevel gear 19 and which is supported within a bearing arrangement 27 at the front end of the cavity 15 for rotatably journaling the intermediate shaft 22 and driven bevel gear 19.

There is supported on the intermediate shaft 22 a dog clutching sleeve 28 that has a splined connection to the intermediate shaft 22 for rotation with this shaft and axial movement along it. The dog clutching sleeve 28 has oppositely facing dog clutching teeth 29 that are adapted to cooperate with complementary dog clutching teeth 31 formed on the gears 19 and 21 for selectively coupling the gears 19 or 21 for rotation with the intermediate shaft 22.

The dog clutching sleeve 28 is connected by means of a pin 32 to a shift plunger 33 that is supported within a bore formed at the forward portion of the intermediate shaft 22. A coil spring 30 is positioned within a groove 34 of the dog clutching sleeve 28 so as to hold the pin 32 in position.

The forward end of the plunger 33 is headed as at 35 and is received within a cam element 36 that is supported within a bore 37 formed in the lower unit housing 12 forwardly of the cavity 15. A cam element 38 is affixed to the lower end of a shift rod 39 and upon rotation of the shift rod 39 will effect reciprocation of the dog clutching sleeve 28 so as to selectively couple the gears 19 or 21 for rotation with the intermediate shaft 22.

The forward, neutral, reverse transmission 16 may be considered to be conventional and, for that reason, further details of its construction and operation are not believed to be necessary in order to understand the construction and operation of the invention.

There is provided a bearing carrier, indicated generally by the reference number 39 that is positioned within the cavity 15 and which at least partially closes the open end of the cavity through the rear face of the lower unit housing 12. This bearing carrier 39 is formed with an enlarged forward portion that supports an anti-friction bearing 41 for journaling the forward end of the driven propeller shaft 24. In a similar manner, an anti-friction bearing 42 is positioned at the rear end of the bearing carrier 39 so as to rotatably journal the rear end of the driven propeller shaft 24 adjacent the propeller 17.

In addition to rotatably journaling the driven shaft 24, the bearing carrier 39 also serves to transmit axial driving thrusts in either the forward or reverse directions from the propeller shaft 24 to the lower unit housing 12 for exerting driving forces in either direction on the associated watercraft. For this purpose, there is provided an outwardly extending flange 43 on the forward end of the propeller shaft 24. Forward driving thrusts are transmitted from this flange 43 to a thrust bearing 44 that is contained within an enlarged portion 45 at the forward end of the bearing carrier 52. This thrust bearing 44 is held axially in place by means of a threaded ring 46 so that driving thrusts will be transmitted directly to the bearing carrier 39.

Rearward driving thrusts are transmitted to the bearing carrier 39 from the flange 43 through a ring 47 that engages the bearing carrier 39. An anti-friction thrust bearing 48 is interposed between the enlarged portion 43 and the thrust member 47 so as to reduce stresses.

It should be noted that the enlarged portion 45 is positioned immediately adjacent the transmission 16 and if driving thrusts were transmitted from this portion of the bearing carrier 39 to the lower unit housing 16, there would have to be a fairly substantial shoulder area to transmit these thrusts. This would enlarge the forward portion of the lower unit housing 12 and adversely affect its streamlining and performance in the water. Therefore, an arrangement is provided for transmitting these driving thrusts from the bearing carrier 39 to the lower unit housing 12 at the rear of the cavity 15. This construction will now be described.

It should be noted that the bearing carrier 39 is provided with an enlarged diameter, rear cylindrical portion 49 that is received within a complementary counterbore formed by a rearwardly facing shoulder 51 of the lower unit housing 12 around the cavity 15. A plurality of threaded fasteners 52 hold the bearing carrier portion 49 into engagement with the shoulder 51 and also will transfer reverse driving thrusts from the bearing carrier 39 to the lower unit housing 12.

A further ring 53 may be supported around the enlarged portion 49 of the bearing carrier 32 and held in place by bolts 54 that are threaded into the bearing carrier 39 radially inwardly of the hub 55 of the propeller 17 so as to provide a smooth and concealed surface.

The enlarged forward portion 45 of the bearing carrier 39 is provided with a circumferential groove in which an O-ring seal 56 is positioned so as to provide a seal in this area and to protect the transmission 16 from water damage.

Figure 2:
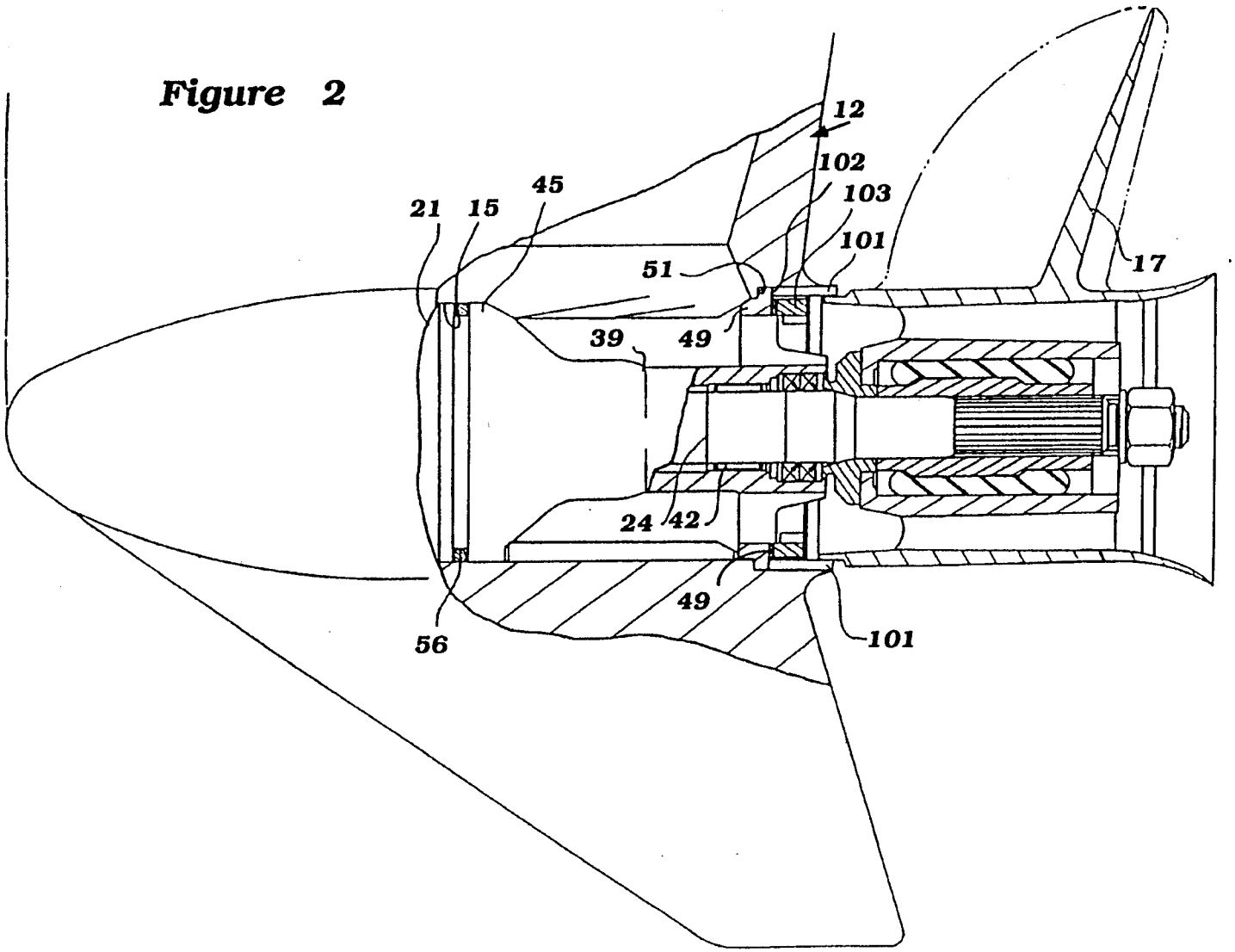
FIG. 2 is a side elevational view, with a portion shown in section, of another embodiment of the invention.
Figure 3:
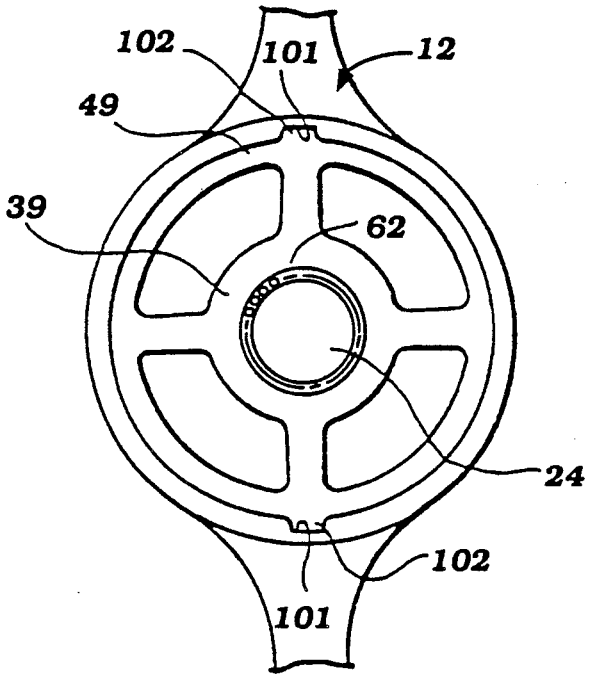
FIG. 3 is an elevational view taken toward the rear of the lower unit of the second embodiment with certain components removed to more clearly show the construction.

FIGS. 2 and 3 show another embodiment of the invention which is generally similar to the embodiment of FIG. 1 and, for that reason, components which are the same as the previously described embodiment have been identified by the same reference numerals. Also, because of these similarities, the transmission 16 has not been illustrated and the forward portion 45 of the bearing carrier 39 has been shown in elevation rather than in cross-section.

In this embodiment of the invention, the counterbore 49 is formed with a pair of keyway-like openings 101 that receive corresponding flanges 102 of the bearing carrier portion 49 so as to hold the bearing carrier 39 against rotation. An externally threaded ring 103 is received within a threaded portion of the counterbore 49 so as to lock the bearing carrier 39 in position and so as to transmit reverse driving thrusts to the lower unit housing 15. In all other regards, as previously noted, this embodiment is the same as the previously described embodiment.

It should be readily apparent from the foregoing description that a number of embodiments of the invention have been illustrated and described and each of which is effective in insuring the ability to transmit high driving thrusts due to a substantial contact area without adversely affecting the streamline shape of the lower unit housing. Although two embodiments of the invention have been illustrated and described, various changes and modifications may be made without departing from the spirit and scope of the invention, as defined by the appended claims.

I claim:

1. In a lower unit for a marine propulsion device comprised of an outer casing defining a cavity extending through a rear face thereof which defines a rear opening, a drive shaft journaled by said outer casing and extending into said cavity, a driven shaft extending at least in part within said cavity and driving a propulsion means, a bevel gear transmission for driving said driven shaft from said drive shaft, a unitary bearing carrier supported within said cavity extending from said bevel gear transmission rearwardly and closing at least in part the rear opening thereof, and bearing means carried by said bearing carrier adjacent said bevel gear transmission and journaling said driven shaft, said bearing means taking thrust from said driven shaft in at least the forward direction and transferring the forward thrust forces to said bearing carrier, the improvement comprising means for transmitting such forward thrust forces from said bearing carrier to said outer housing contiguous to said rear face which is contiguous to the rear opening of said cavity.

2. In a lower unit as set forth in claim 1 wherein the means for transmitting the driving thrust from the driven shaft to the bearing carrier comprises a flange formed on the driven shaft and engaged with an internal race of the thrust bearing, an external race of the thrust bearing being affixed to the bearing carrier.

3. In a lower unit as set forth in claim 2 wherein the bearing carrier has an enlarged forward portion that contains a portion of the bearing means for transmitting the forward driving thrusts from the driven shaft to the bearing carrier and wherein the cross-sectional area at the rear of the bearing carrier in a cross-sectional plane perpendicular to the axis of the driven shaft is greater than the cross-sectional area of the forward end thereof in a parallel plane.

4. In a lower unit as set forth in claim 2, wherein the driving thrusts are transmitted in both directions from the driven shaft to the bearing carrier.

5. In a lower unit as set forth in claim 4 wherein the means for transferring the forward driving thrust from the bearing means to the bearing carrier transmits the forward driving thrust at the forward end of the bearing carrier.

6. In a lower unit as set forth in claim 5 wherein the driven shaft includes a flange formed thereon and engaged with an internal race of the bearing means, an external race of the bearing means being affixed to the bearing carrier whereby the forward driving thrusts are transferred from the flange, through the bearing means to the bearing carrier.

7. In a lower unit as set forth in claim 6 wherein the driving thrusts in the reverse direction are transferred from the driven shaft to the bearing carrier through a further bearing means interposed between the flange of the driven shaft and the bearing carrier.

8. In a lower unit as set forth in claim 7 wherein the bearing carrier has an enlarged forward portion that contains the portion of the bearing means for transmitting the forward driving thrusts from the driven shaft to the bearing carrier and wherein the cross-sectional area at the rear of the bearing carrier in a cross-sectional plane perpendicular to the axis of the driven shaft is greater than the cross-sectional area of the forward end thereof in a parallel plane.

* * * * *